United States Patent [19]

Morrell et al.

[11] 4,074,778

[45] Feb. 21, 1978

[54] SQUARE HOLE DRILL

[75] Inventors: Roger J. Morrell, Bloomington; Jerome A. Gunn, St. Paul; Gerald D. Gore, White Bear Lake, all of Minn.

[73] Assignee: The United States of America as represented by the Secretary of the Interior, Washington, D.C.

[21] Appl. No.: 705,361

[22] Filed: July 14, 1976

[51] Int. Cl.[2] ..... E21C 13/04; E21C 1/14; E02D 17/14

[52] U.S. Cl. ..... 175/91; 175/106; 175/416; 279/6; 279/16; 299/87

[58] Field of Search ..... 90/15 B; 145/122; 418/61 B; 175/91, 416, 106; 279/6, 16; 299/87; 74/804

[56] References Cited

U.S. PATENT DOCUMENTS

| | | | |
|---|---|---|---|
| Re. 26,383 | 4/1968 | Hubek | 418/61 B |
| 1,241,176 | 9/1917 | Watts | 408/229 |
| 2,586,084 | 2/1952 | Powell | 145/122 X |
| 2,976,027 | 3/1961 | Gallimann | 299/87 X |
| 3,036,821 | 5/1962 | Letts | 299/87 X |
| 3,199,496 | 8/1965 | Kell | 418/61 B |
| 3,771,501 | 11/1973 | DeDobo | 418/61 B |
| 3,922,120 | 11/1975 | McCullough | 418/61 B |

*Primary Examiner*—Ernest R. Purser
*Assistant Examiner*—William F. Pate, III
*Attorney, Agent, or Firm*—Thomas Zack; Donald A. Gardiner

[57] ABSTRACT

A square hole drill having a cutterhead configuration whose outline is in the form of a Reuleaux triangle and which also has a planetary gear drive. Two counter revolving motions are present in the drill at the same time. One is the pure rotary motion of the drill's cutterhead about its own shaft. The other is the circular motion of the cutterhead as a unit about a center line due to its eccentric mounting and drive. To achieve the opposite rotation of the unit as a whole compared to the rotation of the cutterhead about its own axis, a combined meshing planet gear and ring gear are used. The planet gear is directly connected to the cutterhead by a shaft rigidly attached to the gear's front side. At the rear side of the planet gear is the eccentrically mounted drive shaft. Surrounding the external teeth of the planet gear is a larger stationary ring gear with internal teeth to continuously engage the planet gear's teeth. As these teeth become engaged the planet gear rotates on its own shaft and also rotates, in a larger radius, counter to that direction around the ring gear. In the preferred embodiment the rotation about the planet gear's shaft was one third as fast as the planet gear's rotation around the ring gear. The composite effect of these two counter revolutions when considered with the shape of the cutterhead is that the cutting bits transcribe and cut out a square hole.

9 Claims, 22 Drawing Figures

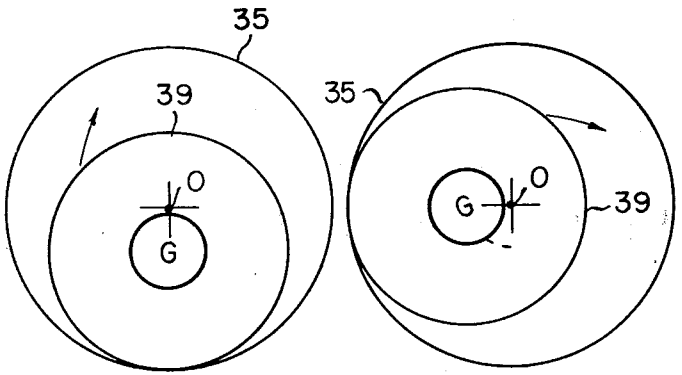
FIG. 6(a)
FIG. 6(b)
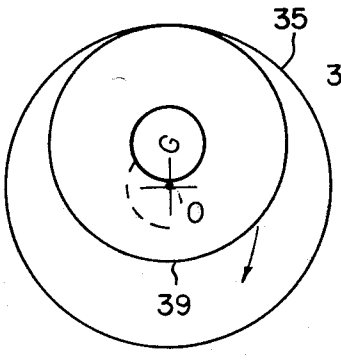
FIG. 6(c)
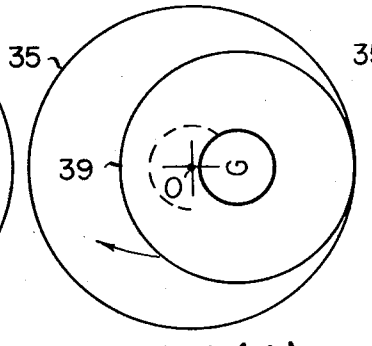
FIG. 6(d)
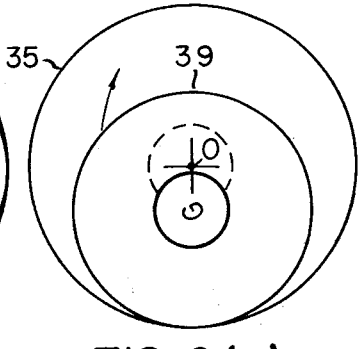
FIG. 6(e)
FIG. 7(a)
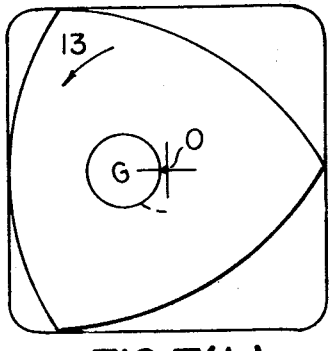
FIG. 7(b)
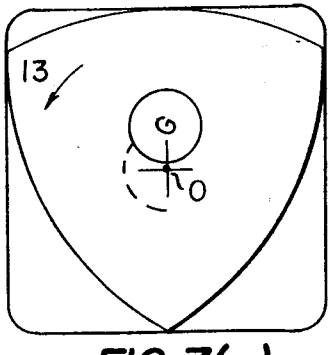
FIG. 7(c)
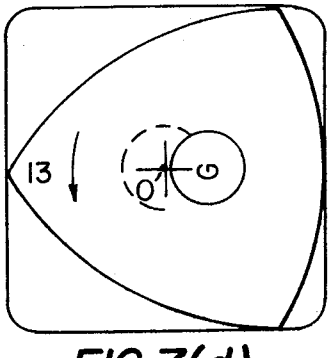
FIG. 7(d)
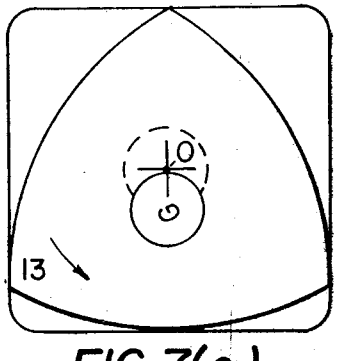
FIG. 7(e)

SQUARE HOLE DRILL

BACKGROUND OF THE INVENTION

1. Field of the Invention

Our invention is a square hole drill which operates by virtue of its cutting head configuration and combined drive train.

2. Description of the Prior Art

Square hole drills using a cutting head based on the Reuleaux triangle configuration are known. A good explanation of the properties of the Reuleaux triangle can be found in the Scientific American magazine of February, 1963 beginning on page 148 in the article entitled "Curves of constant width, one of which makes it possible to drill square holes" by Martin Gardner. In the patent literature the best known references are the United States Patents to S. R. Powell and H. J. Watts bearing U.S. Pat. Nos. 2,586,084 and 1,241,176, respectively. In each of these references the rotation of the Reuleaux triangle cutting head is accomplished by a pure rotary drive with a square guide for the head and a floating chuck for its drive shaft.

The prior art square hole drills have definite drawbacks and limitations in their use. Most of these can be traced to the lack of a positive stable drive train for the cutting head. When a square hole guide tube or other restraining type of device has to be used with the cutting head to insure its proper movement, it creates an additional piece of equipment near the cutting surface which can limit the extent of use, especially for large and deep drilling operations as in the mining field. What we have done is to invent a positive planetary gear drive specifically made for the Reuleaux triangle type of cutting head thus eliminating external guides for the head and floating chucks for its drive. In this way our square hole drill is not only free standing, operative to cut large and/or deep holes, but can be designed to operate in practically any substance. Different sized cutting heads can, within about a fifty percent size range, be adapted to fit on the same drive train. Should the hole size to be drilled fall outside of this range, changes can be made to the gear train to accommodate the new sized cutting heads.

SUMMARY OF THE INVENTION

The subject matter of this invention is a square hole drill whose cutting head configuration is based on the Reuleaux triangle and whose drive train operates by two counter simultaneous rotations. The first rotation is the rotation of the center axis of the planet gear about itself as it meshes with and rotates within a larger fixed ring gear. The second rotation which is counter to the first is also caused by the planet gear as it meshes with the ring gear and is the circle formed by the center of the planet gear as it rotates inside the ring gear.

The primary object of this invention is an improved square hole drill.

BRIEF DESCRIPTION OF THE DRAWINGS

FIGS. 6(*a*)–(*e*) sequentially depicts in a schematic way the movement of the output shaft as the planet gear revolves within the stationary ring gear.

FIGS. 7(*a*)–(*e*) sequentially disclose the rotating cuttinghead.

It should be kept in mind that although our preferred embodiment is directed to a square hole drill used in conjunction with a mine high recovery auger for extracting coal, and other mined materials, the basic principles on which it operates can be used to drill practically anything to any desired depth with any sized hole. In the coal mining field our invention would find particular use since it would allow the drilling square rather than round holes which would extract a much higher percentile of the in situ coal than is presently taken with conventional round hole drilling techniques. Estimates indicate this percentile will increase from its present recovery rate of about 59 percent to about 75 percent.

Figure 1:
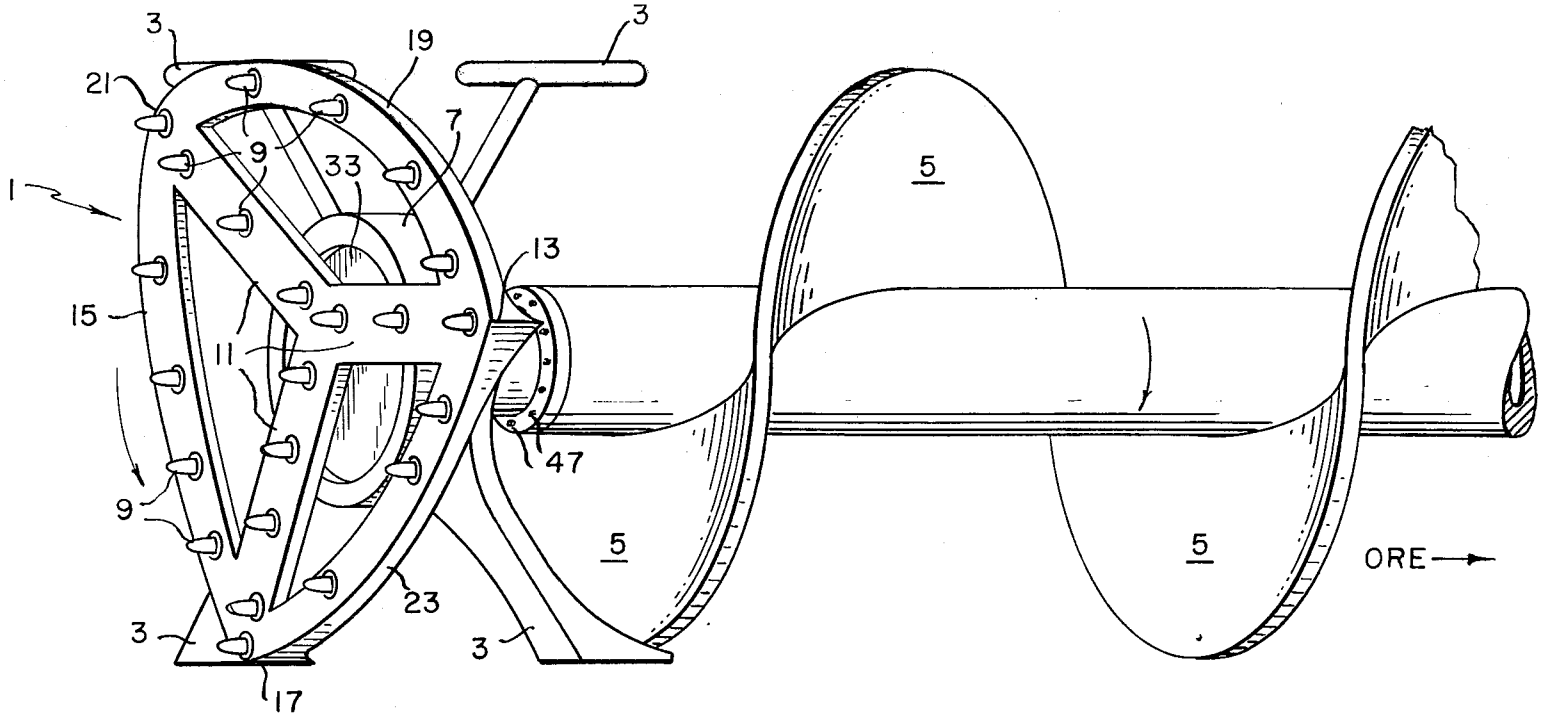
FIG. 1 illustrates, in perspective, the preferred embodiment of our invention mounted to the front end of a mine ore auger recovery unit.

The high recovery auger system of FIG. 1 has a drill cutterhead 1; the four stabilizing braces 3 a pair of each of which engage the floor and ceiling of the mine; the giant auger 5 used to convey extracted material from the mine face; and the drive unit train within housing 7. It is the combined cutterhead and drive unit train -to be described in detail- which constitutes our invention. The braces and auger are conventional and are illustrated merely to show how the invention may be adapted to one specific purpose. Both the auger flights and its center axis, rotate in the same direction as depicted by the arrows.

Extending from the front of the cutterhead towards the mine working surface are a series of spaced forward facing cutter bits 9. These bits are arranged so that each apex supports at least one bit. Other bits may be placed at the center of the cutterhead. Around its perimeter, or along the three intersecting members 11 to maximize its effectiveness in various materials. The outside configuration of the cuttinghead when viewed frontally is that of a Reuleaux triangle. To construct such a head an equilateral triangle with the apexes 13, 17, and 21 is first constructed. Then using any of these three apexes as the center an arc is drawn which intersects the other two apexes. Repeating this last step with the other two apexes gives the Reuleaux triangle.

As pointed out in the February 1963 Scientific American article mentioned heretofore, the Reuleaux triangle is a curve of constant width like a circle. As such it can be enclosed within a square and when rotated one of its sides will always be in contact with the sides of the square. It is also the rotor of least area of a square. These characteristics have strongly suggested to us that the Reuleaux triangle configuration would be ideally suited to drill a square hole. The remaining features shown in FIG. 1 include the three perimeter arcs 15, 19, and 23 of the cuttinghead, the drive train cylindrical housing 7, and the bolts 47 to mount the input shaft to the rotatable drive power source through holes.

Figure 2:
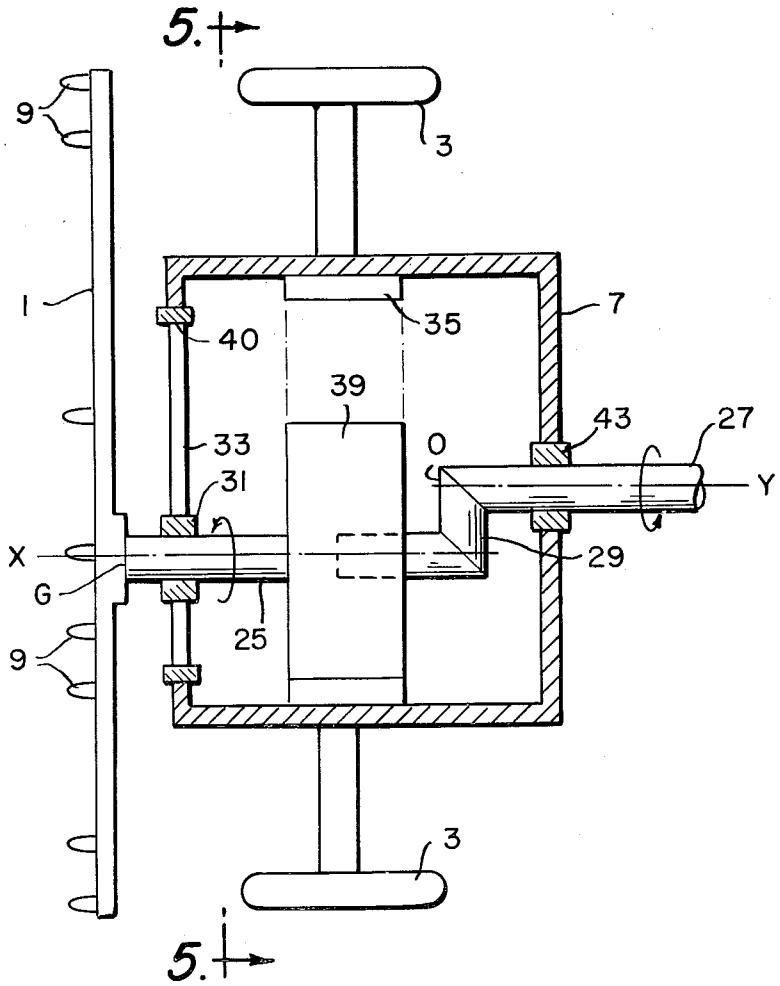
FIG. 2 is a schematic cross-sectional side view of the front end of the FIG. 1 system.

The internal workings of the drive train are better shown in the FIG. 2 cross-sectional view of the front end of cuttinghead and drive train. Within the gear case housing 7 are the front end of the input shaft 27 with its eccentric crank type connection 29 fixed to the back of the planet gear 39, the output shaft 25, and the stationary ring gear 35. In operation, as the pure rotatary movement of shaft 27 occurs in the direction of the arrow, as shown, the eccentrically mounted planet gear itself rotates within the larger surrounding ring gear. Since the ring gear is fixed with respect to the housing and the planet gear is eccentrically mounted, the effect of the rotation of the output shaft and planet gear is to produce a circular motion of the planet gear and its attachments in a direction opposite to the rotated drive shaft about the axis Y. The combined circular rotation of the planet gear around the ring gear and the rotation of input shaft 27 about its own axis is transmitted to the output shaft 25 with its own center line axis X.

Figure 3:
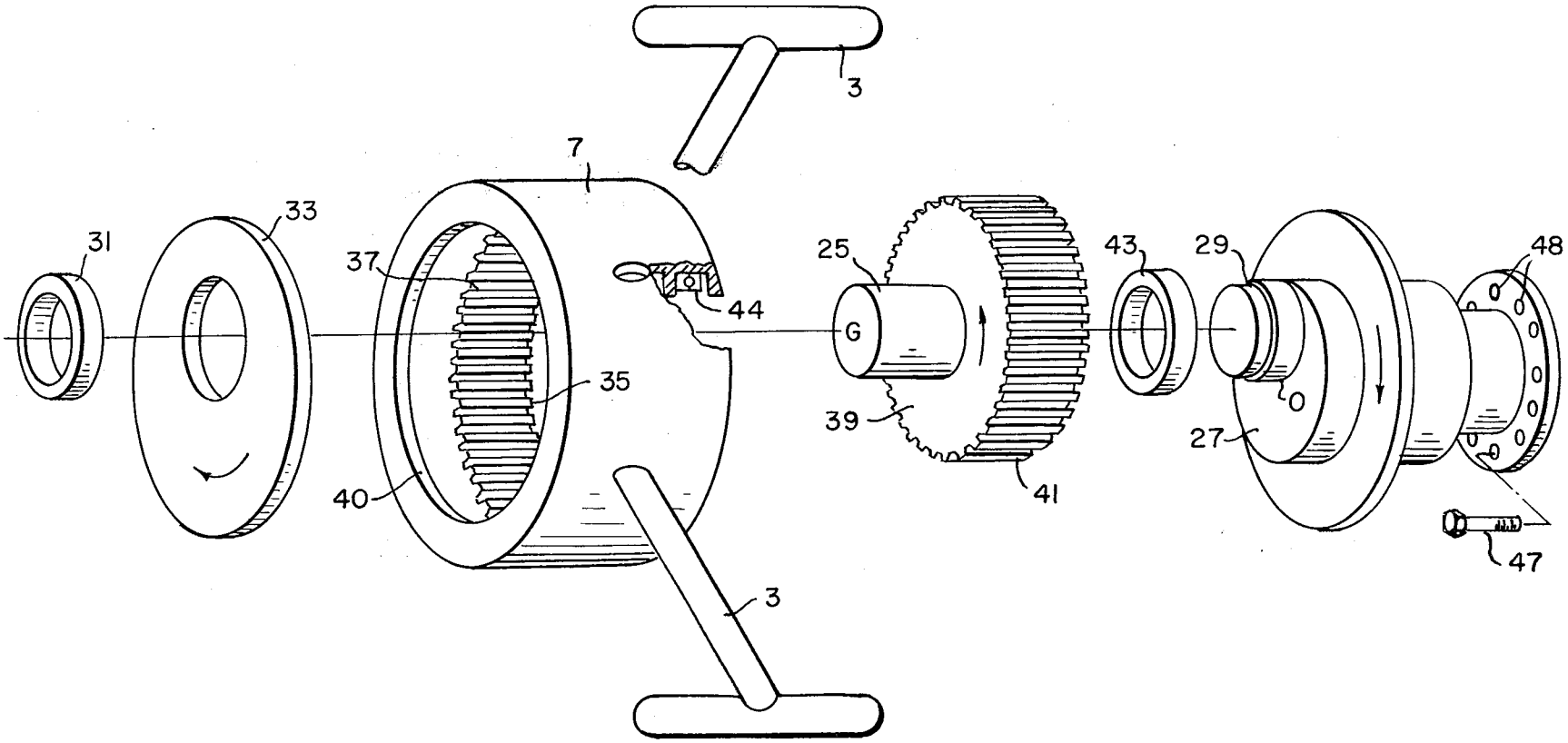
FIG. 3 is an exploded view of the drive gear system of the drill.

The exploded view of the gear drive train of FIG. 3 shows many of the previous mention components in greater detail. The housing 7 is partially cut away in section and only one of the four braces 3 is shown in place. The planet gear 39 has a number of external teeth 41 which engage the internal teeth 37 of the stationary ring gear. In our working embodiment there were four teeth in the ring gear for every three teeth in the planet gear. As will be explained in more detail with respect to FIG. 8, the pitch diameters D and d for the ring and planet gears, respectively, were in the same 4:3 ratio i.e., if the ring gear diameter D was 12 inches, the planet gear's diameter d would be 9 inches. Also shown are the bolts 47 used to attach the drive train housing to its power source by insertion in holes 48; the thrust bearings 43 and 44: the end plate 33 with its hole to receive output shaft 25; the housing 7 with its flanged lip 40; and the seal bearing 31. Together these members along with the eccentric, output shaft, planet gear, output shaft, and ring gear form what may be termed the eccentric drive unit.

Figure 4:
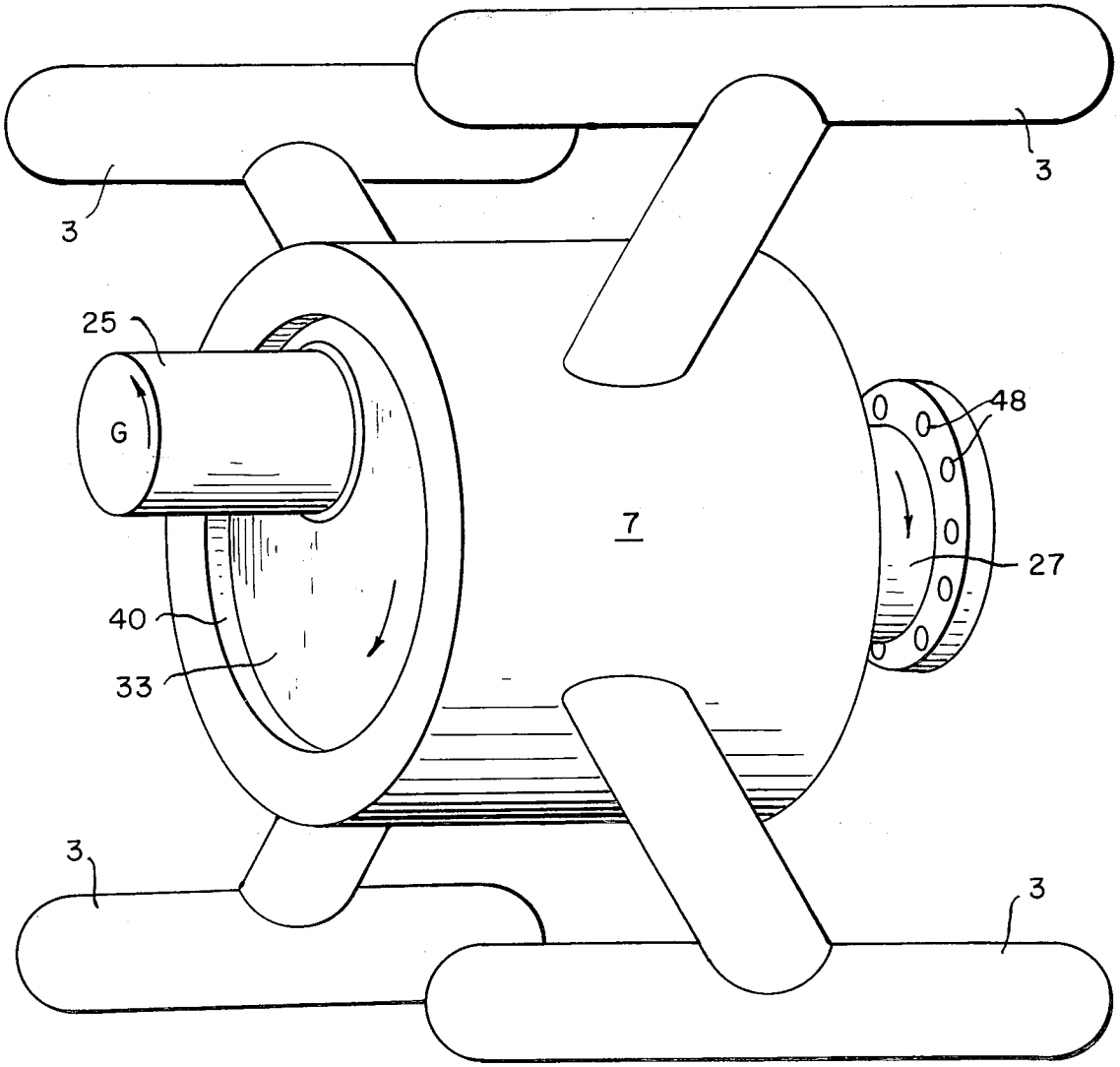
FIG. 4 is an assembled view of the FIG. 3 gear system.
Figure 8C:
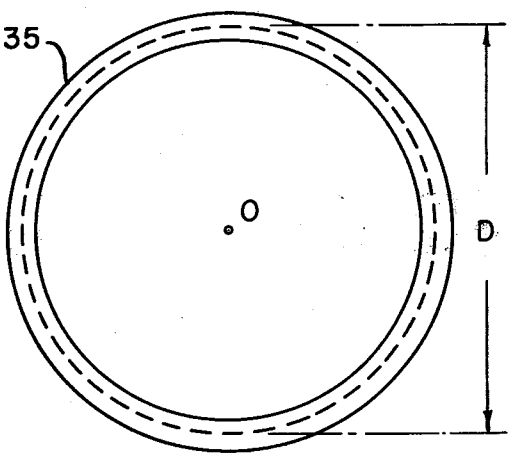
FIGS. 8(*a*)–(*e*) illustrate specific parameters of the cuttinghead, gears, square hole, and eccentric mount.
Figure 8B:
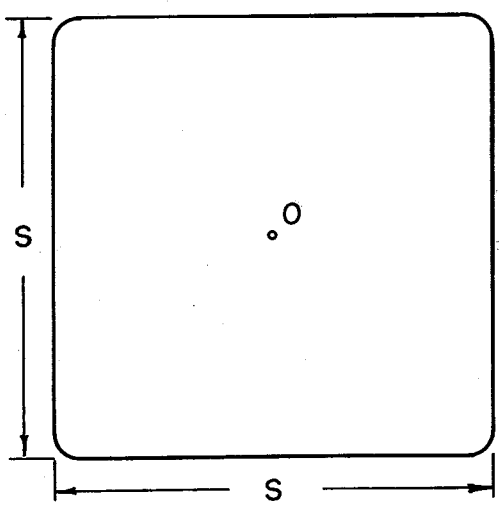
Figure 8A:
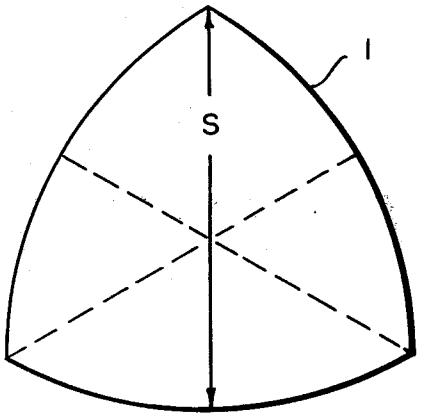
Figure 8E:
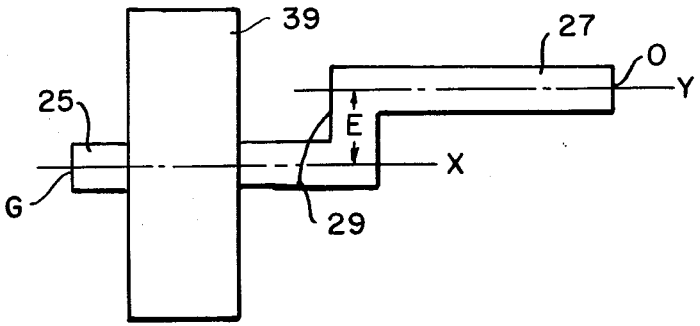
Figure 8D:
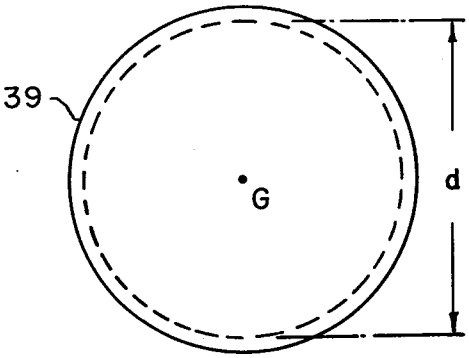

FIG. 4 is the assembled view of the FIG. 3 drive unit. When connected as shown, the movable end plate 33 has the output shaft 25 extending through it. As this shaft rotates the plate also rotates inside of the flanged lip 40 between it and the ring gear. The end of the output shaft is designated by the letter G and is rigidly fixed to the rear of the cuttinghead at the back of the intersection of its three support members 11. In this setup the motion of the letter G is the same as that of the cuttinghead as both rotate in unison.

Figure 5:
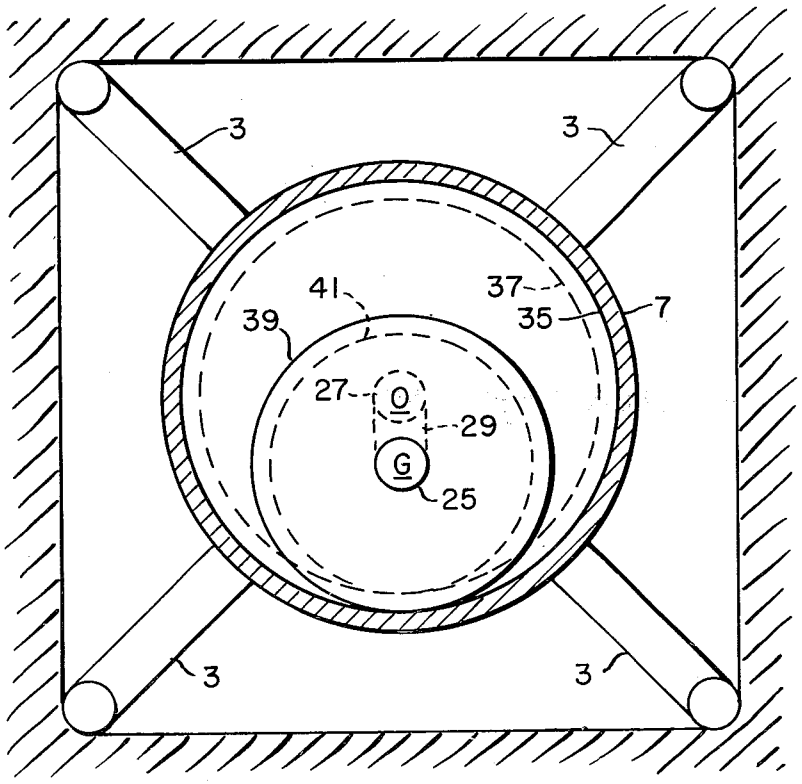
FIG. 5 is a schematic front view as observed along lines 5—5 in the direction of the arrows in FIG. 2.

FIG. 5 is a schematic sectional view along line 5—5 of FIG. 2 showing the positions of the ends of the output and input shafts at a specific time. The letter O designates the end of the input shaft 27. Each is rotating in a different direction. The shaft 27 about its own axis and the shaft 25 around both the Y axis and its own axis X. The gear 39 has the output shaft 25 rigidly attached to it. As the input shaft rotates it moves the planet gear around the ring gear which then rotates the end G. FIGS. 6(*a*)–(*e*) illustrate in more detail the time sequence of rotation of the output shaft end G and hence the rigidly attached cuttinghead 1. Beginning at FIG. 6(*a*) the planet gear 39 is at the bottom of the ring gear 37 and the letter G approximately vertical. At the FIG. 6(*b*) position the planet gear has rotated clockwise about 90° around the ring gear. Meanwhile the center G has moved 30° in the opposite direction. In FIG. 6(*c*) the letter G has moved another 30° counterclockwise while the planet gear has moved 90° clockwise. Still later in time at the point represented by FIG. 6(*d*) the letter G has rotated 90° and the planet gear 270° in an opposite direction. Finally in FIG. 6(*e*) the planet gear has completed one revolution clockwise while the output shaft end G has moved counterclockwise 120°. Thus, for every three revolutions of the planet gear around its ring gear the output shaft will have rotated one revolution in an opposite direction.

The significance of FIG. 6 becomes more apparent when considered in conjunction with FIGS. 7(*a*)–(*e*). Like FIGS. 6(*a*)–(*e*) these figures represent a time sequence of the movements of the output shaft. They represent the same angular movement corresponding to FIG. 6(*a*)–(*e*) e.g. in FIG. 7(*d*) and FIG. 6(*d*) the angular movement is the same. However, here in the FIG. 7 sequence the cuttinghead is shown attached to the end of the output shaft. This is clearly important since it is the head which does the actual cutting of the square hole. In our description of the sequence being followed we will refer to apex point 13, it being understood that the other two cuttinghead apex points (17 and 21) are simultaneously rotating in the same direction. Starting at FIG. 7(*a*) the point 13 rotates 30° counterclockwise while the output shaft rotates 90clockwise degrees to the position in FIG. 7(*b*). Thus the center shaft rotation is the same as that of the planet gear about the ring gear while the apex rotation is the same as that of the output shaft about its own axis. After one complete revolution of output shaft about its ring gear, the apex point would have moved 120° in the opposite direction or the same amount and the same direction as the output shaft G. Where it not for the unique shape of the cuttinghead and the placement of the cutting bits thereon, the described drive would not cut a square hole. When one of the Reuleaux triangle's apexes rotates through 120° each of its other two apexes will also rotate through 120° so that the next proceeding apex will be located where the first one initially was located. This happens because of the 120° separation between adjacent apexes and the fact that the Reuleaux triangle is a constant width curve.

Certain parameters are critical for our preferred embodiment to work as described. FIGS. 8(*a*)–(*e*) depict these parameters FIGS. 8(*a*) and 8(*b*) illustrate that the side S of the square hole being drilled can initially be determined by measuring the arc distance from one of the apexes. FIGS. 8(*c*) and 8(*d*) show the pitch diameter measurements D and d for the ring gear (8(*c*)) and the planet gear (8(*d*)) respectively. Mathematically the ring gear's number of teeth and pitch diameter are related to the planet gear's number of teeth and pitch diameter by the following two equations:

(1.) $d = 3/4D$ where $d$ is the pitch diameter for the planet gear and D the pitch diameter for the ring gear.

(2.) $t = 3/4T$ where $t$ is the number of teeth in the planet gear and T the number of teeth in the ring gear.

FIG. 8(*e*) illustrates how the eccentric axial offset distance E is measured between the two parallel axis X and Y of the output and input shafts, respectively. To satisfy the previously described characteristics this distance E must be:

(3.) $E = 1/8D$ where, as before, D is the pitch diameter of the ring gear. This axial offset distance, is measured between the power side 27 of the eccentric crank shaft and its output side 25.

As depicted in FIG. 8(*b*) the square hole is not actually a perfect square at its four corners. It is a hole with two sets of equal parallel lines as sides with slightly rounded edges at the four corners. In order to achieve the desired cut the dimensions of the ring gear's pitch diameter D must be changed to accommodate the range of sizes of the sides S of the hole according to the following table:

Table I

| RING GEAR PITCH DIAMETER D | CUTTERHEAD SIZE RANGE (MIN. - MAX.) FOR S |
|---|---|
| 6 inches | 6 to 12 inches |
| 12 inches | 12 to 24 inches |
| 24 inches | 24 to 48 inches |
| : | : |
| n | n to 2n |

Thus, if the size of the hole to be drilled is more than twice the pitch diameter of the ring gear it will be necessary to change the ring gear to a larger size. Any change of the ring gear's size will require corresponding changes in the planet gear and the eccentric distance in accordance with equations (1), (2), and (3) above. Changes may be to either reduce or increase the hole size. Outside of these requirements and the type of drill bits used, our invention may be modified so that it can be used to drill any sized square hole through any known material.

Figure 9B:
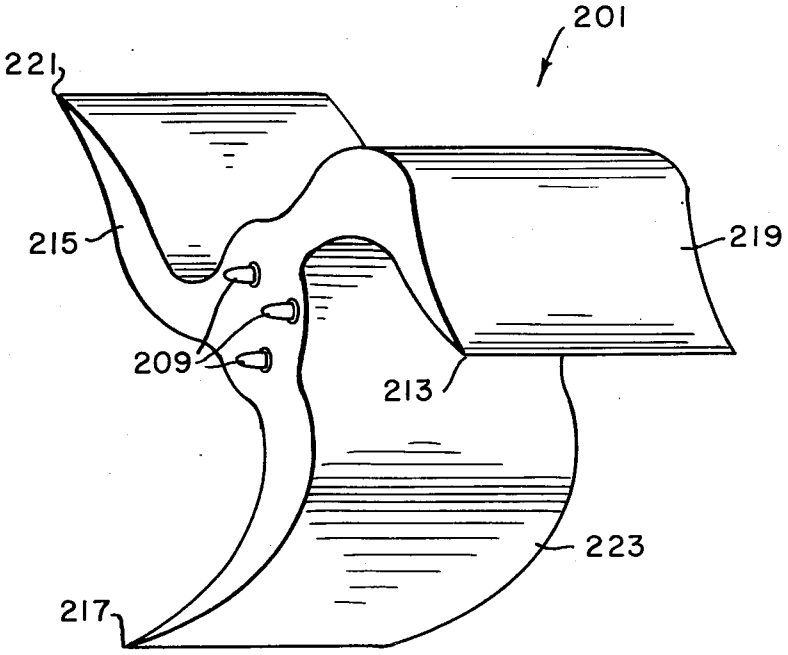
FIGS. 9 (*a*)–(*b*) illustrate possible alternate head designs to accommodate different types of materials or hole sizes.
Figure 9A:
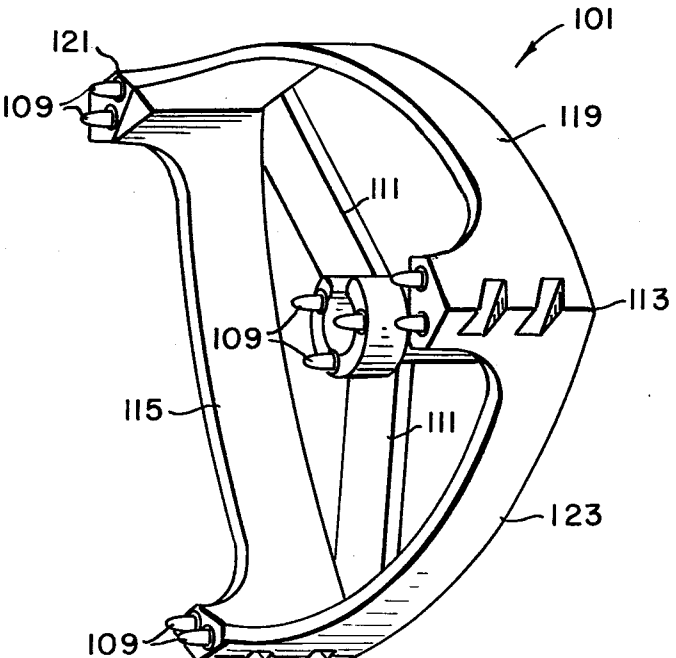

FIGS. 9(*a*) and 9(*b*) are alterate design embodiments for the cutterhead. Each is configured to resemble a Reuleaux triangle. The FIG. 9(*a*) cutterhead 101 has bits 109 at each of three apexes 113, 117 and 121 as well as at its center joining the three support members 111. They are shaped peripheral edges 115, 119, and 123 all are spaced the same distance from their respective apexes. The FIG. 9(*b*) cutterhead 201 also has a series of three center bits 209 and three apexes 213, 217, and 221. Lines drawn between these three points would form a Reuleaux triangle.

Although our invention has been described with respect to a specific preferred embodiment, it should not be limited thereto but only by the claims which follow.

I claim:

1. A square hole drill system comprising:

(a) a rotatable cutterhead having drill cutting surfaces about at least part of its periphery and facing towards the surface to be cut, said periphery being configured so that its outer most cutting surfaces would outline the apexes of a Reuleaux triangle;

(b) a gear drive operatively connected to said cutterhead to cause its rotation, said drive train having a stationary first gear which continuously meshes with a second gear that rotates around said first gear in a direction opposite to said cutterhead rotation, said second gear being rotated by an output shaft at one side attached to move in unison with said cutterhead; and (c) an eccentric drive connected to the other side of said second gear to cause it to move around the first gear.

2. The drill of claim 1 wherein said first gear is larger than said second gear in its pitch diameter and has internal teeth, said second gear having meshing external teeth.

3. The drill of claim 2 wherein there are four internal teeth of the first gear for every three teeth of the second gear.

4. The drill of claim 3 wherein the pitch diameters of said first gear and second gears are in the ratio of 4:3 and said eccentric drive has an input shaft connected to said second gear which is axially offset one-eight of the first gear's pitch diameter from a connecting power shaft.

5. The drill of claim 1 wherein said drill cutting surfaces are a series of spaced bits which extend around said Reuleaux triangle configuration with at least one cutting surface being at each apex of the triangle.

6. The drill of claim 1 wherein said second gear revolves around said first gear three times for each revolution of said cutterhead in the opposite direction.

7. The drill of claim 1 wherein said gear drive and eccentric drive are in a common housing with a movable end plate closure receiving said second gear's output shaft.

8. The drill of claim 1 also including an auger mine recovery system with drill supporting braces connected to said eccentric drive.

9. The drill of claim 1 wherein the pitch diameter of said first gear is not greater than any one side of the drilled square hole.

* * * * *